United States Patent [19]

Maekawa

[11] Patent Number: 4,744,684

[45] Date of Patent: May 17, 1988

[54] IMPACT-TYPE RECORDING APPARATUS

[75] Inventor: Tomohiro Maekawa, Yokohama, Japan

[73] Assignee: Canon Kabushiki Kaisha, Tokyo, Japan

[21] Appl. No.: 922,307

[22] Filed: Oct. 23, 1986

[30] Foreign Application Priority Data

Nov. 5, 1985 [JP] Japan ..... 60-246148

[51] Int. Cl.[4] ..... B41J 9/38; B41J 9/42

[52] U.S. Cl. ..... 400/167; 400/157.2; 400/144.2; 101/93.02

[58] Field of Search ..... 400/144.2, 157.2, 167; 101/93.02

[56] References Cited

U.S. PATENT DOCUMENTS

| | | | |
|---|---|---|---|
| Re. 29,745 | 8/1978 | Gomi | 101/93.29 |
| 3,900,094 | 8/1975 | Larsen et al. | 197/1 R |
| 3,964,384 | 6/1976 | Johnston | 101/93.48 |
| 4,308,794 | 1/1982 | Adamoli et al. | 101/93.03 |
| 4,491,069 | 1/1985 | Kawahara | 101/93.03 |
| 4,569,607 | 2/1986 | Takemoto | 400/167 |
| 4,603,985 | 8/1986 | Helinski | 400/167 |

FOREIGN PATENT DOCUMENTS

| | | | |
|---|---|---|---|
| 65-620 | 1/1982 | European Pat. Off. | 101/93.48 |
| 55-123487 | 9/1980 | Japan | 101/93.48 |
| 60-15184 | 1/1985 | Japan | 400/167 |
| 120076 | 6/1985 | Japan | 400/167 |

OTHER PUBLICATIONS

"Hammer Rebound Retention", Xerox Disclosure Journal vol. 1, No. 4, Apr. 1976, K. R. Frechette, pp. 23.

*Primary Examiner*—Paul T. Sewell

*Attorney, Agent, or Firm*—Fitzpatrick, Cella, Harper, & Scinto

[57] ABSTRACT

An impact-type recording apparatus is disclosed. The apparatus of this invention comprises: a platen for supporting a recording medium; hammer means guided for reciprocal movement between a strike position where the hammer means strikes a character element to force it against an inked ribbon and a recording medium supported on the platen and a stand-by position where the hammer means is kept apart from the platen; energizing means for generating a force acting to move the hammer means from the stand-by position to the strike position; and control means for actuating the energizing means while the hammer means is being moved from the stand-by position to the strike position for striking purposes and while the hammer means is being moved from the strike position to the stand-by position for returning purposes. This construction enables the high-speed operation of the printing mechanism to be carried out with a low level of noise generation.

8 Claims, 6 Drawing Sheets

IMPACT-TYPE RECORDING APPARATUS

BACKGROUND OF THE INVENTION

1. Field of the Invention

The present invention relates to an impact-type recording apparatus wherein an inked ribbon is forced by a hammer against a piece of paper or other recording medium laid on a platen, to record or print characters thereon.

2. Description of the Prior Art

The daisywheel printer has heretofore been known as an example of this type of recording apparatus. A typical daisywheel printer employs a printer head assembly including: a carriage arranged to travel backward and forward along the printing surface of a piece of paper partially wrapped around a platen; a type wheel or daisywheel having a font formed on the ends of "petals" extending radially from its center hub; a motor for driving the type wheel; a hammer unit; and an inked ribbon; with the wheel, motor, hammer and inked ribbon being disposed on the carriage. The hammer unit is commonly constituted by: a magnetic coil; a hammer capable of impacting characters provided on the periphery of the type wheel by the energization of the coil; and resilient means, such as a spring, for restoring the hammer to its initial position after completion of this energized striking motion. In such a daisywheel printer, characters are printed in the following way. A character to be printed is selected on the basis of data on various printing operations, and the magnetic coil for the hammer is energized so as to drive the hammer and thus cause it to strike the selected character, thereby forcing this character against the paper or other recording medium, via the inked ribbon.

In this case, when the hammer strikes each individual character against the paper via the inked ribbon, a certain level of impact is needed. However, the optimum level of impact depends upon the surface area of each character to be brought into contact with the paper. For this reason, a conventional type of impact printer usually has a built-in ROM (read-only memory) constituting part of a printer control section, and the ROM stores a table of impact control data corresponding to the surface area of each character. The impact of each character is controlled with reference to this table. In general, since the mass of the hammer is constant, this type of impact control is provided by controlling the strike velocity of the hammer, that is, by controlling the electric current flowing in the magnetic coil of the hammer unit.

Once the hammer strikes the character to be printed, it is returned to its initial position by a repelling force inherent in the platen and the resilient force of the resilient means, such as a spring, and collides against a stopper provided for defining the initial position. Since the hammer is returned at a velocity substantially as high as the strike velocity thereof, it collides against the stopper with a heavy impact, and thus a large noise is generated. Therefore, in order to reduce the above-mentioned impact and noise, a conventional type of impact printer commonly employs, as stopper means, a resilient damper made of such a material as rubber having a small restitution coefficient.

However, such a prior-art method suffers from the following drawbacks. Even if such a rubber-made stopper is used with the hammer unit in the aforementioned way, it is difficult to prevent the hammer from striking the stopper with a heavy impact accompanied by a large noise. Specifically, in order that the hammer may be caused to strike a character having a large surface area with a sufficient impact, the hammer must be moved toward the object character at high velocity. This increases the velocity at which the hammer is returned to its initial position, and thus a large impact noise is generated. Similarly, when the velocity of movement of the hammer is to be enhanced for high-speed printing, such an impact noise is further increased.

The above-noted problems are common not only to daisywheel printers but also to all the impact-type recording apparatus mentioned previously in the field of this invention.

SUMMARY OF THE INVENTION

Accordingly, it is an object of the present invention to provide a novel and improved impact-type recording apparatus wherein it is possible to reduce the impact and noise produced when a hammer is returned and strikes a resilient damper serving as a stopper.

It is another object of the present invention to provide a novel and improved impact-type recording apparatus having a simple construction.

To these ends, the present invention provides an impact-type recording apparatus comprising:

a platen for supporting a recording medium;

hammer means guided for reciprocal movement between a strike position where the hammer means strikes a character element against an inked ribbon and a recording medium supported on the platen and a stand-by position where the hammer means is kept away from the platen;

energizing means for generating a force acting to move the hammer means from the stand-by position to the strike position; and control means for actuating the energizing means while the hammer means is being moved from the standby position to the strike position for striking purposes and while the hammer means is being moved from the strike position to the stand-by position for returning purposes.

Further objects, features and advantages of the present invention will become apparent from the following description of a preferred embodiment of the present invention with reference to the accompanying drawings. dr

DESCRIPTION OF THE PREFERRED EMBODIMENT

A preferred embodiment of the present invention will be described in detail below, with reference to the accompanying drawings.

Figure 1:
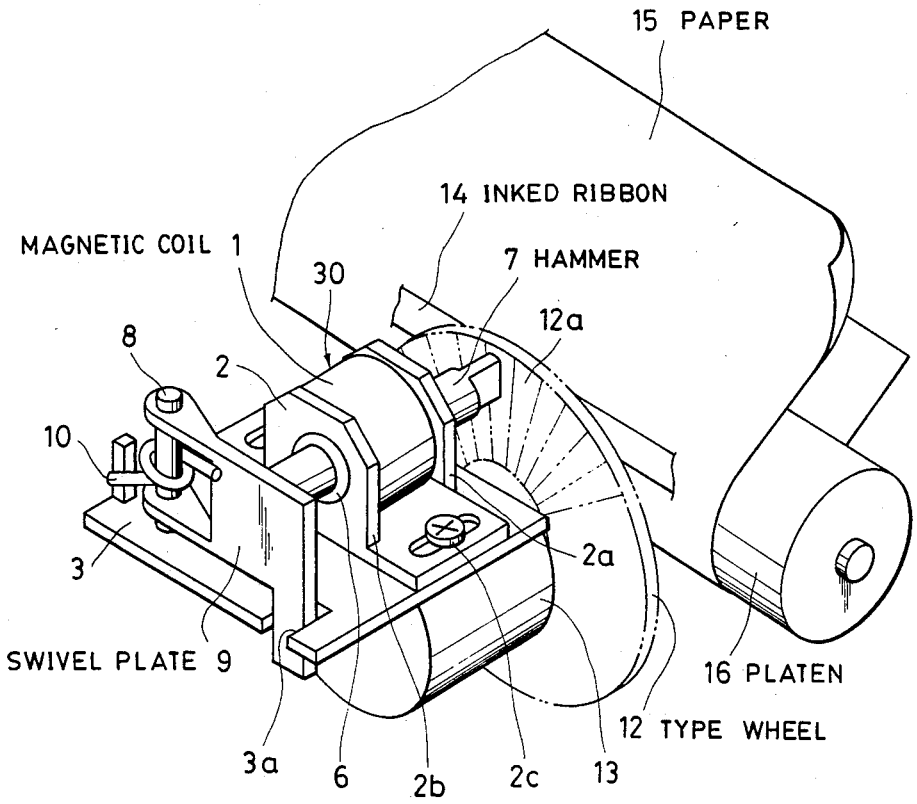
FIG. 1 is a diagrammatic, perspective view of a preferred embodiment of an impact-type recording apparatus in accordance with the present invention, showing a portion of a printing mechanism incorporated in this embodiment.
Figure 2:
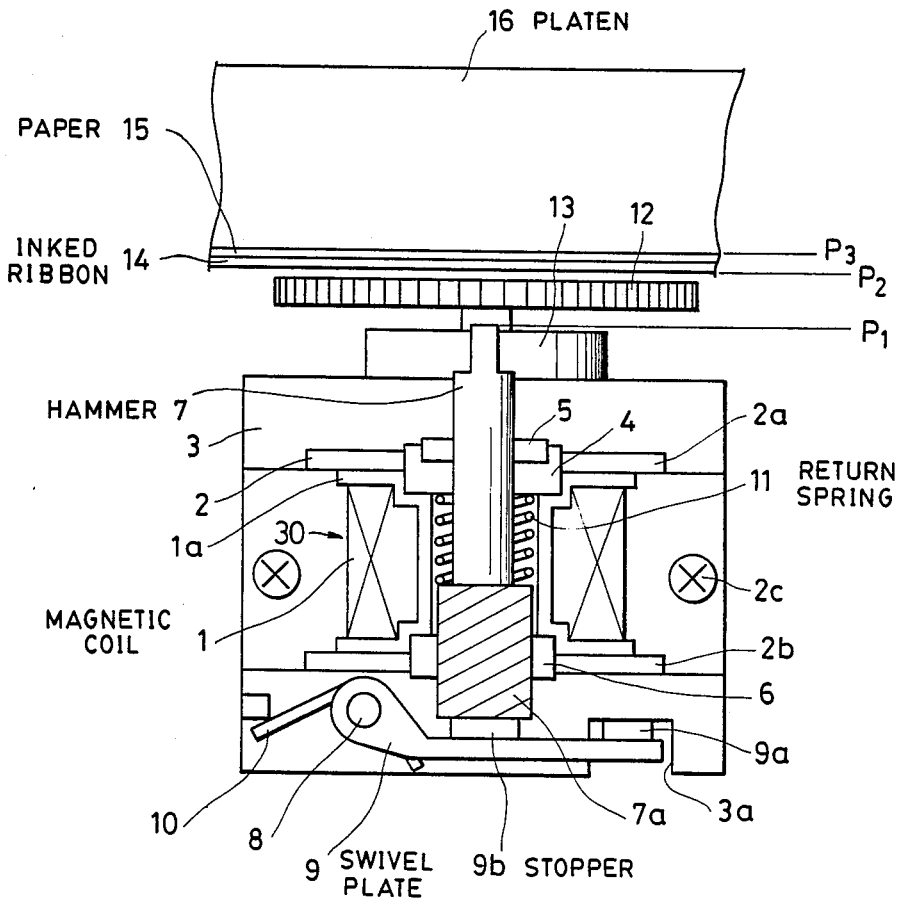
FIG. 2 is a diagrammatic, top plan view of the apparatus shown in FIG. 1, illustrating in section a portion of a hammer unit.

FIGS. 1 and 2 are respectively a perspective view and a partially sectional top plan view, each diagrammatically showing a portion of a printing mechanism for a daisywheel printer constituting a preferred embodiment of the present invention.

In FIGS. 1 and 2, a sheet of paper 15 is partially wrapped around a platen 16, and a carriage (not shown) is disposed for free movement along the breadthwise length of the platen 16. A type wheel 12, a motor 13, an inked-ribbon cassette (not shown), and a hammer unit 30 are mounted on the carriage. The wheel 12 is of the "petal" type in which a plurality of spring fingers 12*a* having characters (not shown) on their end portions extend radially from the center hub. The motor 13 is arranged to cause the rotation of the wheel 12 such as to select a character to be printed. An inked ribbon 14 accommodated by a cassette (not shown) is disposed with a certain level of tension in the clearance between the paper 15 and the type wheel 12. The hammer unit 30 serves as means for striking the inked ribbon 14 against the paper 15 with a selected character formed on the wheel 12.

The hammer unit 30 is assembled on a base plate 3 mounted on the carriage (not shown). The unit 30 has the following parts: a supporting frame 2 secured to the base plate 3 by means of screws 2*c* and having a pair of opposing supporting plates 2*a*, 2*b*, the supporting plates respectively being provided with holes which are axially aligned with each other; a yoke 4 (FIG. 2) tightly fitted in the hole in the supporting plate 2*a* and having a central hole; a bush 6 tightly fitted in the hole in the supporting plate 2*b* and having a central hole; a bobbin 1*a* having both axial ends secured to the supporting plates 2*a* and 2*b* through the yoke 4 and the bush 6, respectively, the bobbin 1*a* having an axial through bore of a substantial length; a magnetic coil 1 formed on the bobbin 1*a* and serving as energizing means which will be explained later, the magnetic coil 1 being connected to a hammer drive circuit 28 which will also be mentioned later; and a bush 5 fitted in a recess formed in the surface of the yoke 4 facing the wheel 12.

The mentioned members 4, 5, 6 and 7 and the bobbin 1*a* are assembled together in such a manner that their central holes and the bore form a continuous through hole which slidably receives the hammer 7. As shown in FIG. 2, the rearward end portion of the hammer 7 received in the central hole of the bush 6 has a large-diameter portion 7*a* made of magnetic material. A return spring 11 is axially fitted onto the portion of the hammer 7 defined between the magnetic portion 7*a* and the yoke 4, the spring 11 urging the hammer 7 rearwardly, that is, away from a position where the hammer 7 strikes the wheel 12 and inked ribbon 14 against the paper 15.

A supporting shaft 8 is disposed at the location of the base plate 3 which is near the rearward end of the hammer 7. A swivel plate 9 is rotatably supported by the shaft 8 and a coiled spring 10 fitted onto the shaft 8 urges the plate 9 counterclockwise as viewed in FIGS. 1 and 2. The swivel plate 9, as shown in FIG. 2, has a stopper 9*a* on its free end portion, and the stopper 9*a* is adapted to abut the base edge of a recess 3*a* formed in the base plate 3, thereby limiting the rotation of the plate 9. A stopper 9*b* is secured to the generally central portion of the surface of the plate 9 facing the rearward end of the hammer 7. The stopper 9*b* defines the initial position of the hammer 7 in contact relationship with the rearward end of the hammer 7. The stoppers 9*a* and 9*b* are made of resilient material such as rubber having a low restitution coefficient and a good heat resistance. In this fashion, the swivel plate 9, the stoppers 9*a*, 9*b* and the coiled spring 10 as a whole constitute means for stopping the hammer 7 in a stand-by position where the tip of the hammer 7 is kept separated from the type wheel 12, the inked ribbon 14, the paper 15 and the platen 16.

The operation of the illustrated embodiment will be described below, with reference to FIGS. 1 and 2.

For printing, the magnetic coil 1 is energized, the magnetic portion 7*a* being attracted toward the yoke 4, thereby driving the hammer 7 toward the type wheel 12. As a result, the hammer 7 strikes a selected one of the spring fingers 12*a* against the paper 15 via the inked ribbon 14.

After striking has been completed, the hammer 7 is restored to its initial position by virtue of a restitution force inherent in the platen 16 and the resilient force of the return spring 11. In the initial position, although the rearward end of the hammer 7 collides against the stopper 9*b*, the impact produced by the collision is damped by the resiliency of the stopper 9*b*. Simultanously, the swivel plate 9 is swivelled slightly clockwise as viewed in FIGS. 1 and 2 by the impact of the collision. This swivel motion also acts to reduce the impact. Subsequently, the swivel plate 9 is urged to return to its original position by the force of the coiled spring 10, and thus the stopper 9*a* collides against the base edge of the recess 3*a* in the base plate 3. The impact generated by this collision is damped by the resiliency of the stopper 9*a* per se.

However, as mentioned previously, even if the just-described damping method is adopted, it is difficult to prevent a remarkably large impact from being generated when the rearward end of the hammer 7 collides against the stopper 9*b* and thus a large impact noise is produced.

To solve such problem, the illustrated embodiment is arranged in such a manner that the return motion of the hammer 7 is retarded by re-energizing the magnetic coil 1 while the hammer 7 is being returned to its initial position. Specifically, the magnetic coil 1 also serves as brake means for applying a brake to the hammer 7.

Figure 3:
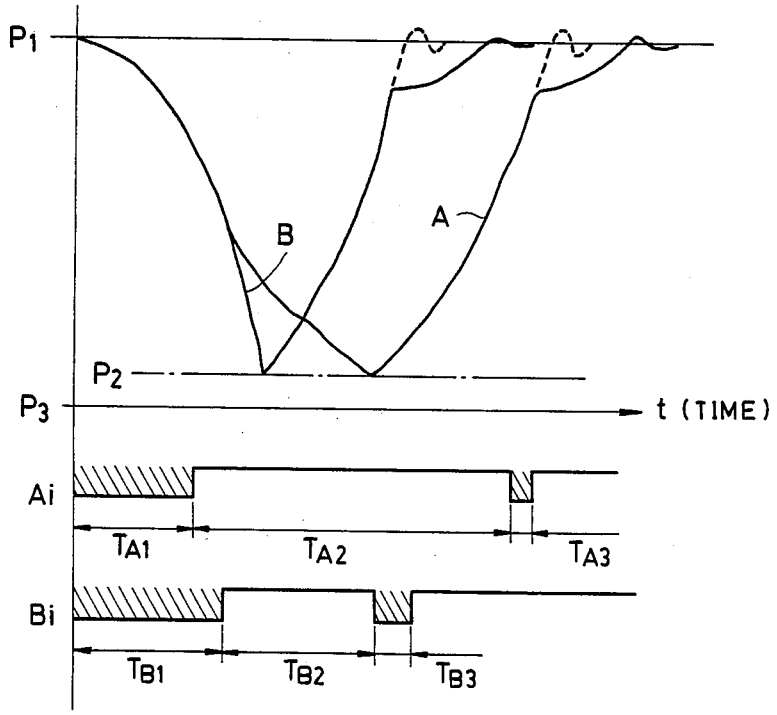
FIG. 3 is a chart used as an aid to explaining the movement of the hammer shown in FIGS. 1 and 2.

FIG. 3 is a graph showing the behaviour of the hammer 7 incorporated in the illustrated embodiment. In the graph, time t is represented by the central horizontal axis indicated by $P_3$.

Variations in the levels of energizing signals $A_i$ and $B_i$ are plotted under and along the axis of time t as viewed in the graph. The signals $A_i$ and $B_i$ are output by a control system described later, and when they become active at a low level, they energize the magnetic coil 1. Above the axis of time t as viewed in the graph, positional variations within the range of behaviour of the tip of the hammer 7 are plotted with time t along the vertical axis. Curves A and B represent the movements of the tip of the hammer 7 (or tracks of the hammer tip) responsive to the energizing signals $A_i$ and $B_i$, respectively. The horizontal line $P_1$ indicates the position of the tip of the hammer 7 when it takes the initial position while the horizontal one-dot chain line $P_2$ indicates the position of the tip of the hammer 7 when it reaches the final strike position. The line $P_3$ (or the axis of time t) indicates the position of the surface of the platen 16 which is adjacent to the strike position $P_2$. The space between the lines $P_2$ and $P_3$ is substantially equivalent to the total of the thicknesses of the inked ribbon 14, the paper 15 and a character raised from the surface of the respective printing types of the type wheel 12. The positional relationship between the lines $P_1$, $P_2$ and $P_3$ is also illustrated in FIG. 2.

The following description concerns the case where the tip of the hammer 7 is moved along the track shown by the curve A in response to the energizing signal output $A_i$ shown in FIG. 3.

As shown, the signal $A_i$ energizes the magnetic coil 1 during time period $T_{A1}$, de-energizing it during time period $T_{A2}$, and thus re-energizing it during time period $T_{A3}$. During time period $T_{Al}$, the hammer 7 is accelerated in the direction in which it strikes the wheel 12, and during the de-energization time period $T_{A2}$ the tip of the hammer 7 reaches the line $P_2$ for the striking action. Subsequently, the hammer 7 is returned toward its initial position $P_i$ by virtue of the restitution force of the platen 16 and the force of the return spring 11. However, shortly before the tip reaches the initial position $P_1$, the coil 1 is re-energized during time period $T_{A3}$. This re-energization again urges the hammer 7 in the direction opposite to that in which it is returned, so that the return motion of the hammer 7 is retarded. As a result, as shown by the curve A, the velocity with which the hammer 7 reaches its initial position $P_1$ and collides against the stopper **9*b* can be greatly lowered as compared with cases wherein the $T_{A3}$ re-energization is not performed (its track is shown by a dotted line). Therefore, the impact generated by the collision of the hammer 7 against the stopper 9*b*** can be greatly reduced, thereby remarkably lowering the level of impact noise.

As previously mentioned in the description of the prior art, the optimum level of impact applied by the hammer 7 against each printing type (or character) depends upon the surface area of each individual character to be brought into contact with the paper 15. Therefore, the time during which the magnetic coil 1 is energized for striking the wheel 12 (or time $T_{A1}$ described above) is varied in proportion to the surface area of each character, thereby obtaining optimum levels of impact. This variation is accompanied by varitions in the aforementioned de-energization and re-energization times.

Figure 4:
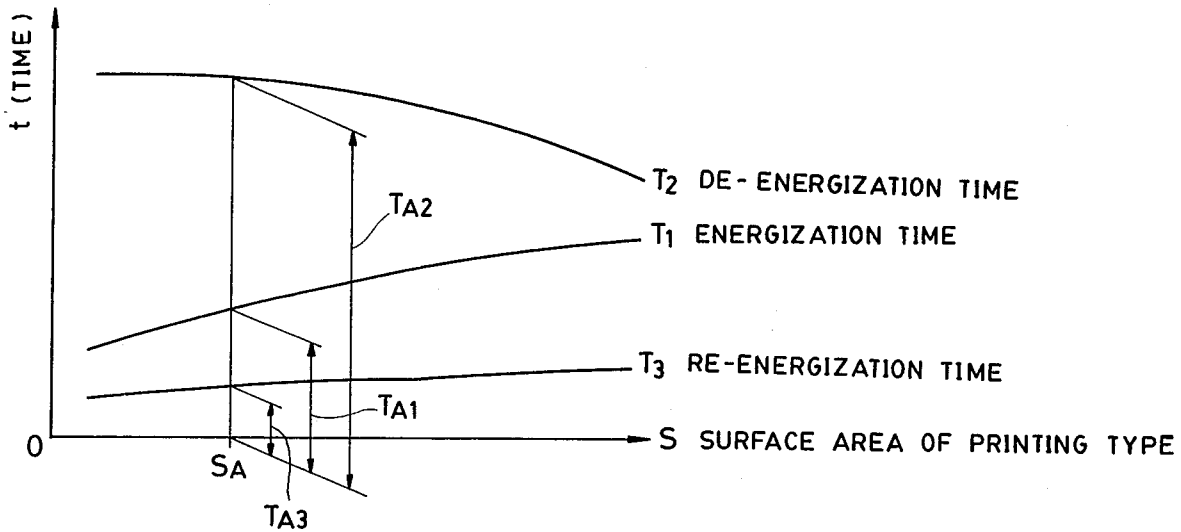
FIG. 4 is a chart of the relationship between the surface area of a printing type (or character) and de-energization, energization and re-energization times.

FIG. 4 is a graph of the relationship between a surface area S of each printing type (or character) and the energization time $T_1$, de-energization time $T_2$ and re-energization time $T_3$ relating to the striking operations. In the graph, the symbol "0" represents the point of time just before the energization of the magnetic coil 1. The symbol "0" is shown solely in FIG. 4. This point in time is omitted from FIG. 3 for convenience. As the surface area S becomes larger, the energization time $T_1$ and de-energization time $T_2$ are made longer and shorter, respectively. In this case, the re-energization time $T_3$ is made slightly longer.

The previous description of the relationship between the energization by the energizing signal $A_i$ and the time t concerns a surface area $S_A$ shown in FIG. 4. In cases where the surface area S is larger than the area $S_A$, the energizing signal $B_i$ shown in FIG. 3, for example, is supplied on the basis of the relationship between the times $T_1$, $T_2$ and $T_3$ plotted in FIG. 3. The signal $B_i$ causes the tip of the hammer 7 to travel along the track shown by the curve B in FIG. 3.

Referring back to FIG. 3, energization time $T_{B1}$ becomes longer, that is, acceleration time becomes longer and since, as shown by the curve B, the hammer 7 is driven at a higher velocity than that of the signal $A_1$, the hammer 7 can suitably strike a character having a larger surface area with an optimum level of impact. Since a large reaction is produced in response to the large impact, the hammer 7 is accordingly urged to return at a higher velocity. However, re-energization time $T_{B3}$ is set to become longer than the time period $T_{A3}$, whereby it is possible to satisfactorily brake the hammer 7.

The following description concerns the construction of a control system for controlling the printing operations described above.

Figure 5:
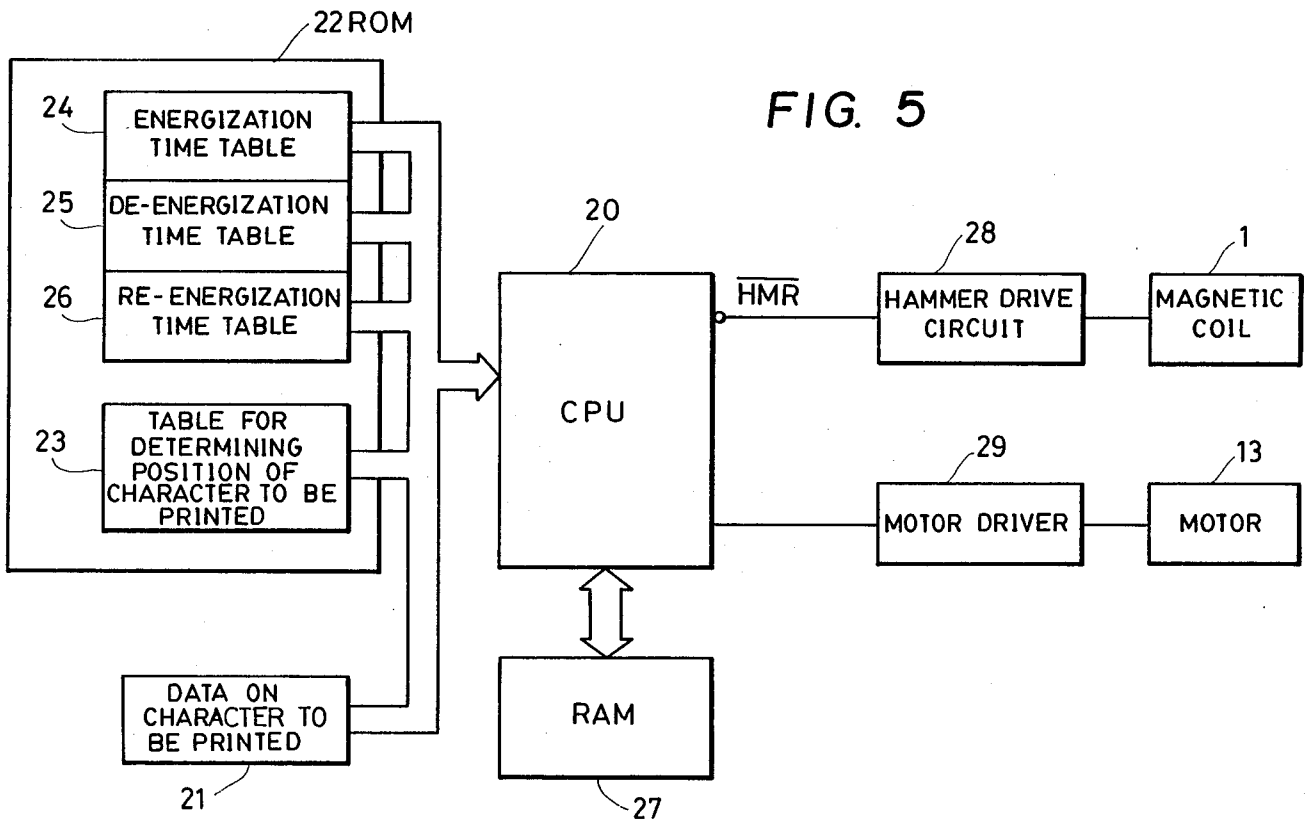
FIG. 5 is a block diagram of the construction of a control system incorporated in the illustrated embodiment of the present invention.

Referring to FIG. 5, the control system incorporated in the illustrated embodiment comprises: a CPU (central processing unit) 20 for controlling the entire printer mechanism; a known ROM (read-only memory) 22; and a known RAM (random access memory) 27. The control system controls the entire mechanism in accordance with a control program stored in the ROM 22. Simultanously, the system effects printing in accordance with data from data block 21 on characters to be printed which is input by a key board or a host system (not shown).

In order to select a character to be printed in correspondence with the character data from the data block 21, the ROM 22 stores: various items of information, such as a control program; and a table 23 for determining the object position of a character to be printed. The table 23 includes an array of data on positions at which the type wheel 12 is caused to stop rotating in correspondence with each character to be printed. With reference to the ROM 22, the CPU 20 controls the motion of the motor 13 via a motor driver 29, causing the type wheel 12 to rotate to a position where the hammer 7 strikes a character to be printed.

Also, the CPU 20 outputs an energizing signal $\overline{HMR}$, and the hammer unit 30 is controllably driven by means of a hammer drive circuit 28 for energizing the magnetic coil 1 when the signal $\overline{HMR}$ takes a low level.

In order that the CPU 20 may be caused to generate the energizing signal $\overline{HMR}$ in the manner shown in FIG. 3, the ROM 22 stores an energization time table 24, a de-energization time table 25 and a re-energization time table 26 associated respectively with the energization time $T_1$, the de-energization time $T_2$, and the re-energization $T_3$ for the previously-described striking operations corresponding to each individual character to be printed. The values of a data array stored in each of the tables 24, 25 and 26 are shown in FIG. 4.

The RAM 27 serves as memory means such as a line buffer capable of temporarily storing one line of the character data 21 at a time.

Although not shown in FIG. 5, it is a matter of course that the CPU 20 is connected to other control systems for controlling printer mechanisms and various sensors required for printer control.

Figure 6:
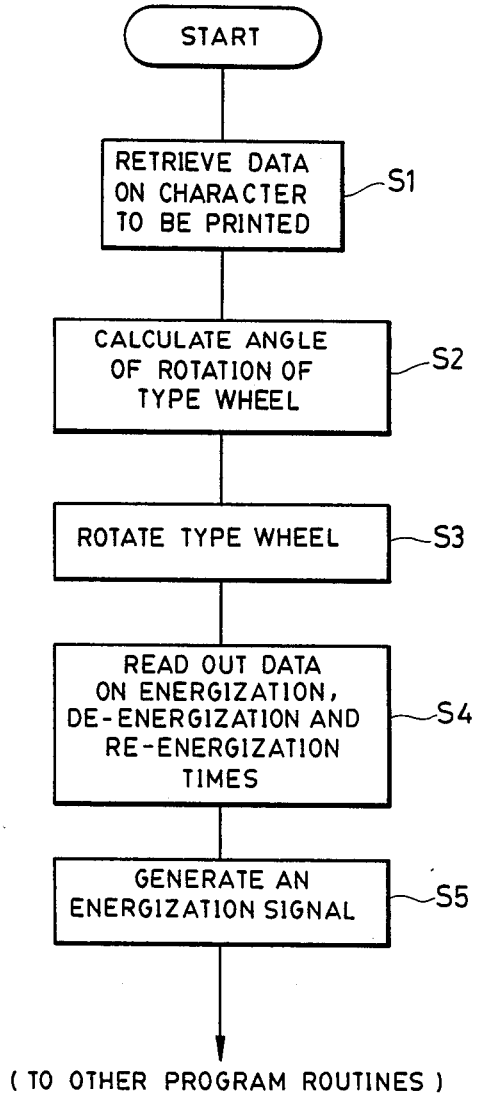
FIG. 6 is a flow chart of the procedures of control executed by the CPU shown in FIG. 5.

The CPU 20 having the above-described construction controls the printing operations in accordance with the control procedures shown in FIG. 6.

Referring to FIG. 6, in Step S1, the CPU 20 retrieves an item of the data from the data block 21 on an object character from the RAM 27 or a keyboard (not shown).

In Step S2, data on an object position where the wheel 12 is caused to stop in accordance with the character data from the data block 21 is obtained through data conversion in the table 23 stored in the ROM 22. Subsequently, the required angle of rotation of the type wheel 12 is calculated from the thus-obtained data as well as data on the actual position of the type wheel 12 which is rotating.

In Step S3, the motor 13 is driven in correspondence with the angle of rotation thus calculated, causing the wheel 12 to rotate accordingly and thereby locating an object character at the position where it is to be printed.

In Step S4, in order to strike an object character in accordance with the character data 21, the CPU 20 reads out data on the energization, de-energization and re-energization times $T_1$, $T_2$ and $T_3$ respectively from the associated time tables 24, 25 and 26 stored in the ROM 22.

In Step S5, the CPU 20 delivers the energizing signal $\overline{HMR}$ corresponding to the thus-obtained data to the hammer drive circuit 28. As shown in FIG. 3, the circuit 28 energizes, de-energizes and re-energizes the magnetic coil 1 in response to the signal $\overline{HMR}$, thereby effecting printing.

Subsequently, the process proceeds to the one-column feed of the carriage (not shown) and the inked ribbon 14, or to other processing routines such as carriage return and line feed of the paper 15, when required. After the required routines have been completed, the process returns to Step S1, and the above-described operations are repeated.

During the printing operations explained above, the hammer 7 is returned to its initial position while its motion is being retarded. Therefore, since the rearward end of the hammer 7 collides against the stopper **9*b* at a remarkably low velocity, the impact and noise produced by this collision is greatly reduced, thereby enabling the operation of the printing mechanism to be carried out with a low level of noise generation. Even if the hammer 7** is driven at higher velocity than the prior art, low-noise printing can still be effected, whereby it is possible to achieve high-speed printing without much noise.

The illustrated embodiment is arranged in such a manner that the re-energization time $T_3$ is varied in proportion to the surface area of each character to be printed. However, even if the time $T_3$ is fixed as a predetermined time interval, the present invention is effective in reducing the impact of the collision.

It should be noted that the present invention can be effectively applied not only to daisywheel printers but also to all the impact-type recording apparatus mentioned previously in the field of this invention. In addition, the present invention can also be adapted for recording apparatus, such as wire or dot matrix printers, in which the recording means is made integral with the striking means.

In addition to coil means, an electromechanical conversion element such as a piezoelectric element may be employed as energizing means for urging hammer means toward the wheel-striking position and braking it while it is being returned.

Moreover, the present invention can be applied to a system in which hammer means includes a plate spring having a wheel-striking portion, the spring being biased by a magnet, and the hammer means (or plate spring) being released from the biased state by energizing a coil.

The level of the force generated by the energizing means may be varied by changing the level of voltage applied to the energizing means as well as the period during which electricity is supplied to such means.

While the above provides a full and complete disclosure of the invention, various modifications, alternative constructions and equivalents may be employed without departing from the true spirit and scope of the invention. Therefore, the above description and illustrations should not be construed as limiting the scope of the invention, which is defined solely by the appended claims.

What is claimed is:

1. An impact-type recording apparatus comprising:

a platen for supporting a recording medium;

hammer means guided for reciprocal movement between a strike position where said hammer means strikes a character element against an inked ribbon and a recording medium supported on said platen and a stand-by position where said hammer means is kept away from said platen;

energizing means for generating a force acting to move said hammer means from said stand-by position to said strike position;

control means for actuating said energizing means while said hammer means is being moved from said stand-by position to said strike position for striking purposes and while said hammer means is being moved from said strike position to said stand-by position for returning purposes; and stopper means for stopping said hammer means at said stand-by position, said stopper means including a swivel plate which is capable of swivelling about a fulcrum thereof in such a direction as to reduce impact caused by said hammer means when said hammer means is returned from said strike position to said stand-by position, said stopper means further including spring means for resiliently stopping said swivel plate at said stand-by position.

2. An impact-type recording apparatus as claimed in claim 1, wherein said energizing means includes a coil.

3. An impact-type recording apparatus as claimed in claim 1, wherein said control means causes said energizing means to generate a force sufficient to prevent said hammer means from moving toward said strike position.

4. An impact-type recording apparatus as claimed in claim 2, wherein said cotnrol means includes:

first memory means for storing a first set of data representative of said force generated by said energizing means for the striking operation of said hammer means; and second memory means for storing a second set of data representative of the timing of the actuation of said energizing means during return of said hammer means, said first set of data stored in said first memory means corresponding to one of said second set of data on actuation timing stored in said second memory means.

5. An impact-type recording apparatus as claimed in claim 4, wherein said control means further includes third memory means for storing a third set of data representative of the force generated by said energizing means for return of said hammer means, one of said third set of data corresponding to said respective data stored in said first memory means.

6. An impact-type recording apparatus comprising:

a platen for supporting a recording medium;

hammer means guided for reciprocal movement between a strike position where said hammer means strikes a character element against an inked ribbon and a recording medium supported on said platen and a stand-by position where said hammer means is apart from said platen;

brake means arranged to be energized while said hammer means is returned from said strike position to said stand-by position, thereby reducing the velocity of movement of said hammer means; and stopper means arranged for colliding with said hammer means for stopping said hammer means at said stand-by position, said stopper means being supported such as to be freely swivelable about a single point, thereby allowing the impact applied by said hammer means to be dissipated.

7. An impact-type recording apparatus as claimed in claim 6, wherein said brake means is arranged in such a manner that the start-up timing thereof is varied in response to the velocity of return of said hammer means.

8. An impact-type recording apparatus as claimed in claim 6, wherein said brake means is arranged in such a manner that the level of the braking force thereof is varied in response to the velocity of return of said hammer means.

* * * * *

UNITED STATES PATENT AND TRADEMARK OFFICE

CERTIFICATE OF CORRECTION

PATENT NO. : 4,744,684

DATED : May 17, 1988

INVENTOR(S) : TOMOHIRO MAEKAWA

It is certified that error appears in the above-identified patent and that said Letters Patent is hereby corrected as shown below:

IN THE [56 REFS]
Line 17, "pp. 23." should read --p. 23.--.

COLUMN 2
Line 50, "dr" should be deleted.

COLUMN 4
Line 52, "behaviour" should read --behavior--.
Line 62, "behaviour" should read --behavior--.

COLUMN 5
Line 48, "varitions" should read --variations--.

COLUMN 6
Line 28, "key board" should read --keyboard--.

COLUMN 8
Line 30, "purposes; and" should read --purposes;¶ and--.
Line 48, "cotnrol" should read --control--.

Signed and Sealed this

Eleventh Day of April, 1989

*Attest:*

DONALD J. QUIGG

*Attesting Officer*

*Commissioner of Patents and Trademarks*